United States Patent [19]

Glutting

[11] Patent Number: 4,773,437

[45] Date of Patent: Sep. 27, 1988

[54] PORTABLE BLIND

[76] Inventor: Roy H. Glutting, 305 S. Val Vista, #390, Mesa, Ariz. 85204

[21] Appl. No.: 6,374

[22] Filed: Jan. 23, 1987

[51] Int. Cl.[4] ..... E04H 15/58; F16G 13/00; E06B 9/00; B21F 27/00

[52] U.S. Cl. ..... 135/117; 135/901; 160/351; 160/135; 59/79.1; 256/32; 256/47; 403/206

[58] Field of Search ..... 160/350, 368 R, 135, 160/130, 351; 256/45, 32, 47; 135/117, 119, 901, 900, 902, DIG. 9, 97, 111; 403/206, 207, 209; 59/79.1, 90

[56] References Cited

U.S. PATENT DOCUMENTS

| | | | |
|---|---|---|---|
| 795,646 | 7/1905 | Plummer | 160/351 WX |
| 2,018,177 | 10/1935 | Kruft | 403/209 X |
| 2,335,274 | 11/1943 | Hampton | 135/119 X |
| 3,192,542 | 7/1965 | Mills, II | 135/119 X |
| 3,323,530 | 6/1967 | Smith | 135/901 X |
| 3,423,072 | 1/1969 | Bernstein | 256/32 X |
| 3,428,108 | 2/1969 | Singer | 160/135 |
| 3,651,851 | 3/1972 | Curtis | 160/135 |
| 3,709,237 | 1/1973 | Smith | 135/901 X |
| 3,913,598 | 10/1975 | Glutting, Jr. et al. | 135/117 X |
| 4,473,087 | 9/1984 | Cavender | 135/901 X |

FOREIGN PATENT DOCUMENTS

| | | | |
|---|---|---|---|
| 509853 | 2/1955 | Canada | 256/32 |

*Primary Examiner*—Richard J. Johnson
*Assistant Examiner*—D. Neal Muir
*Attorney, Agent, or Firm*—Gifford, Groh, VanOphem, Sheridan, Sprinkle and Dolgorukov

[57] ABSTRACT

A portable blind for hunting having a support structure which is laterally expandable by interconnecting identical frames to each other and to a standard member, each frame having a connecting portion adapted to be received within a loop of an adjacent frame member. A camouflaged cover is clipped to the support structure. Vertical extending members are pivotally attached to frame members to provide additional vertical coverage.

9 Claims, 2 Drawing Sheets

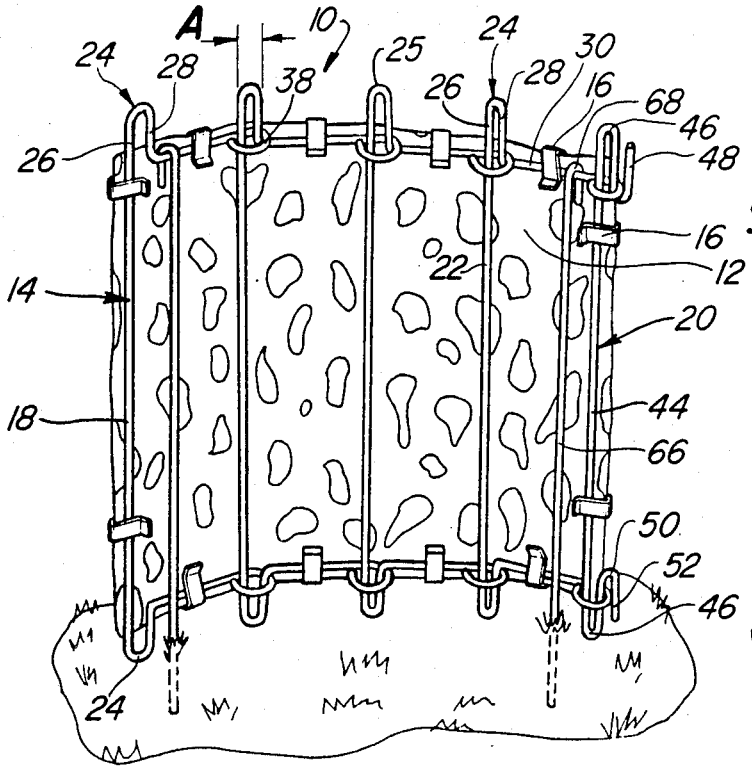
Fig-1
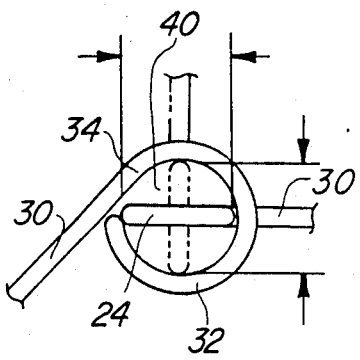
Fig-2
Fig-3
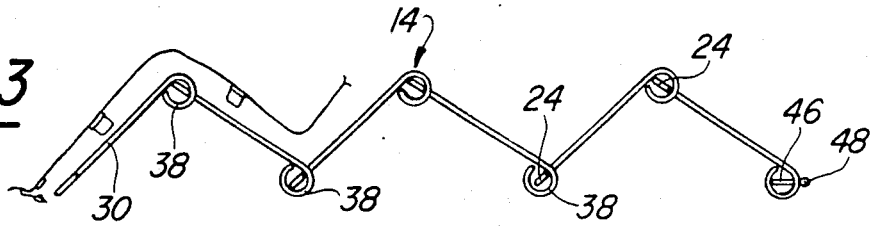
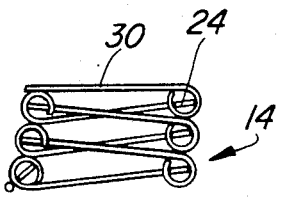
Fig-4
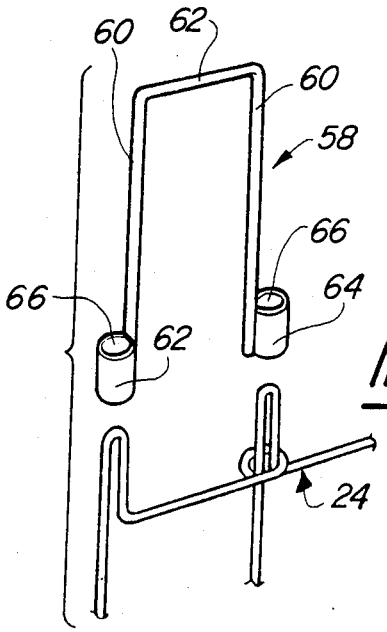
Fig-5

PORTABLE BLIND

BACKGROUND OF THE INVENTION

I. Field of the Invention

The present invention relates to blinds for use in hunting or other outdoor activities, and more particularly, relates to hunting blinds which may be easily assembled in a variety of sizes and shapes and dissassembled for easy transportation.

II. Description of the Prior Art

Hunting blinds for shielding hunters from the view of prey are well know. Frequently, hunting blinds are in the form of screens having a front surface with a mural depicting an animal or foliage, behind which a hunter crouches while waiting for game to appear. Such blinds have a cover of flexible material supported over a rigid frame. It is necessary to transport these blinds to remote and isolated areas for use in hunting. Thus, the hunter may be required to transport the blind, together with his weapon and supplies, long distances across rugged terrain. These blinds are cumbersome and difficult to transport and set up.

It is known to join a plurality of vertically elongated members by hinges so that the elongated members may be folded for transportation and storage purposes. It is, also, known to pivotally and removably attach rectangular frames to vary the size and shape of the blind, as in my invention previously disclosed in U.S. Pat. No. 3,913,598. In my previously disclosed blind, rectangular frames having cross members are pivotally attached by S-shaped hinges. The frames are rigidly positioned relative to each other by lock members which engage the ends of the cross members. The relative position of the frames may be altered by bending the lock member to form a new angle. However, the frames and cross members are relatively heavy and cumbersome. Thus, the frames are difficult to transport, and are not well suited for carrying on the back of the hunter. Additionally, the shape of the blind cannot be altered without utilizing new lock members and/or bending the previously-shaped lock members.

Therefore, because hunting is frequently done in remote areas which vary greatly in topographical and geographical features from location to location, it is desirable to have a portable hunting blind which is readily and easily alterable in size and shape. Additionally, it is desirable to have a blind which is lightweight and easily transported on the back of a hunter.

SUMMARY OF THE INVENTION

The present invention achieves these goals by providing a hunting blind having a support structure over which a lightweight camouflage material is affixed. The support structure is formed by connecting the loops formed on one frame member with U-shaped connectors on a standard. Each frame member has a pair of U-shaped connecting portions having dimensions equivalent to the connectors of the standard. The width of the support structure may be extended laterally by connecting the loops of an adjacent frame member to the U-shaped connecting portions of adjacent frame members. The loops define apertures having a major axis for accepting the connecting portion when a lateral axis of the connecting portion is aligned coplanar with the major axis. Once interconnected, the frames may be pivotally positioned relative to an adjacent frame member. Additionally, a vertical extending member may be pivotally mounted to the frame member for selectively increasing the vertical height of the support structure. A lightweight mesh camouflage cover is secured to the support structure by clips.

It is, therefore, an object of this invention to provide a portable blind which may be readily assembled and disassembled for easy transportation.

It is yet another object of this invention to provide a portable blind which may be quickly assembled and disassembled.

It is another object of the invention to provide a portable blind which may be formed into a variety of sizes and shapes.

It is a further object of the invention to provide a portable blind which is lightweight and inexpensive.

It is yet further an object of the invention to provide a portable blind which is easily transportable on the back of a hunter.

It is still another object of the invention to provide a portable blind which has connected frames which may be fixedly positioned relative to each other.

BRIEF DESCRIPTION OF THE DRAWINGS

The advantages of the present invention will become apparent to one skilled in the art when the following description of the preferred embodiment for processing the invention is read in connection with the accompanying drawing wherein like numerals refer to like or equivalent parts, and in which:

FIG. 1 is a perspective rear view of the portable blind in position for use;

FIG. 2 is a top view of a portion of a looped portion of one frame member accepting the connecting portion of an adjacent frame member shown in two different positions;

FIG. 3 is a top perspective view of the support structure in position for use;

FIG. 4 is a top view of the support structure in a folded position;

FIG. 5 is an exploded perspective view of an extending member and two frame members;

DETAILED DESCRIPTION OF THE PREFERRED EMBODIMENT

Figure 6:
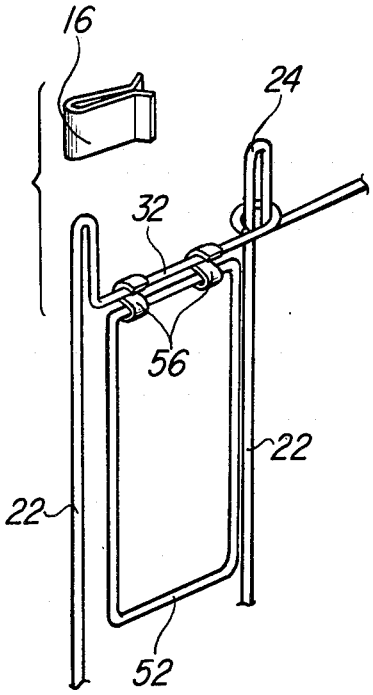
FIG. 6 is a alternative embodiment of an extending member shown in the collapsed position.

A portable blind 10 according to the invention is shown in position for use in FIG. 1. A camouflage cover 12 is secured to a support structure 14 by a plurality of clips 16.

The support structure 14 is formed by connecting a frame 18 to a standard 20. The frame 18 is formed of a continuous rod or wire of any suitable material such as metal or plastic. The material must be generally rigid but be capable of resilient deflection. The frame 18 has an upright portion 22 having a U-shaped connecting portion 24 at each end. Each connecting portion 24 has a pair of spaced apart legs 25 connected by a arcuate portion. One leg 26 of the pair of legs 25 extends coaxially from the upright portion 22. The connection portion has a width "a" as shown in FIG. 1 extending from an outer side of the one leg 26 to an outer side of an opposite leg 28. An arm 30 extends from the opposite leg 28 of each connecting portion 24 in a direction generally normal to a longitudinal axis of the upright portion 22. Thus the frame has a generally U-shape with the arms 30 extending in a generally parallel spaced apart relationship.

A loop 38 is formed at the outer end of each arm 30 for connecting the frame to an adjacent frame or to the standard 20. As shown in FIG. 2, the loop 38 is formed with a curved portion 32 extending from a straight portion 34 to provide the loop with a major axis "b" and a minor axis "c". The major axis "b" is slightly larger than the width "a" of the connecting portion for accepting the connecting portion when the width "a" is coplanar with the major axis "b".

As shown in FIG. 1, the support structure is formed by connecting the frame member 18 to the standard 20. The standard 20 has an upright center portion 44 and a U-shaped connecting portion 46 at both ends. The connecting portion of the standard has a width equivalent to the width "a" of the connecting portion 24 of the frame. A retaining portion 48 having a curved portion 50 and a straight portion 52 extends from the connecting portion 46 to form a hook. The frame 18 is connected to the standard 20 by bending each arm 30 outwardly apart to a position at which each connecting portion 46 of the standard may be inserted within the loops 30 of the frame. The connecting portion is inserted in the loop by aligning the width of the connecting portion on the major axis "b" of the loop in the same manner as described above. After alignment, the connecting portion 46 will be received in the loop as the outward pressure on each arm 30 is relaxed to permit the arms to return to a generally parallel spaced apart position. The arms are retained in position by the hook formed of the retaining portion 48 and curved portion 50.

The support structure may be extended laterally by connecting additional identical frames. Each additional frame is connected by spreading the arms and aligning the major axis "b" of the loops with the width "a" of an adjacent frame member in the same manner as set forth above for connection with the standard. Once frame members are so connected, the relative angle of one frame member to an adjacent frame member may be fixedly established by rotating the connection portions within the loops. Since the minor axis "c" is less than the width "a" of the connecting portion, the connecting portion will be compressed within the narrower portion of the loop 38 to hold the frames in a fixed, angular relationship. The frames may thus be aligned to form a nearly straight wall or may be bent into any convenient geometrical shape, such as a W-shape as illustrated in FIG. 3.

The camouflage cover 20 is formed to extend over the support structure 14 and may be larger than the support structure 14. The camouflage cover 20 may be made of any suitable material. In the preferred embodiment, the camouflage cover is formed of a lightweight, flexible nylon mesh. A pattern may be affixed to the material in order to neutralize or naturalize the appearance of the blind. The camouflage cover 20 is secured to the support structure 14 by a plurality of U-shaped clips 16. The camouflage cover 12 is placed in position to cover the support structure 14. Any excess material is folded over the frame and a clip 16 is positioned over the camouflage cover and frame 18 to fix the cover in position in the manner of a clothespin.

Figure 7:
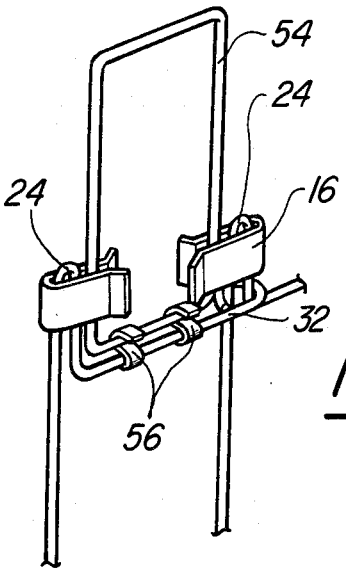
FIG. 7 is a perspective view of the alternative embodiment of the extending member in an extended position.

A vertical extending member 54 may be pivotally attached to the arm 30 at the upper end of the frame 18 to provide increased vertical height as best shown in FIG. 6. The vertical extending member 54 is formed in the shape of a rectangle from any suitable material such as metal wire, or plastic rod. In the preferred embodiment, the extending member is formed of the same material as the frame. The extending member 54 is pivotally attached to the arm of the frame 18 by a pair of S-shaped clips 56. The extending member 54 has a height less than the distance between each of the arms and has a width less than the distance between the upright portion 22 of one frame and the upright portion of adjacent frame or the standard member 20. Thus, the extending member 54 hangs downwardly from the upper arm portion of the frame member in a storage position when not in use as best shown in FIG. 6. When the extending member 54 is pivoted to a extended position, as shown in FIG. 7, increased vertical height is provided for the support structure. The extending member 54 is fixed in the extended position by sliding the U-shaped clip 16 over the connecting portion 24 and the extending member 54 as shown in FIG. 7. The extending members 54 may be placed on each of the frames to provide greater vertical height for the blind or may be positioned on alternate frames to provide gaps or windows between the extending members 54.

An alternate embodiment of the extending member is best shown in FIG. 5. A U-shaped upper member 58 is formed having a pair of spaced apart upright portions 60 and a cross portion 62. Affixed to a free end of each of the pair of upright portions 60 is a tube or cylinder 64 having a central opening 66 secured to each upright portion by any suitable means such as welding or glueing. The central opening 66 has a diameter slightly smaller than the width "a" of the connecting portion 22 of each frame member. The upper member 58 is affixed to the support structure by sliding the connecting portion 24 of the frames members into the central opening 66 of the cylinders 64. The upper member 58 is thus securly mounted upon the support structure 14. Because the diameter of the tube is slightly smaller than the width "a" of the connecting portions the leg portions are pushed together to create an opposing biasing force against the cylinder. The upper member 58 may be removed for transportation or when not desired.

OPERATION

The portable blind is assembled for use by inserting the connecting portions 46 of the standard 20 into the respective loops 38 of a frame 18. This is accomplished by aligning the width "a" of the connecting portion along the major axis "b" of the aperture 40 and inserting one connecting portion 24 into one loop 38. The other loop of the frame member is then inserted over the other connecting portion of the standard by deflecting the arms 30 outwardly until there is sufficient clearance to slip the loop 30 over the connecting portion 24. The standard may then be rotated within the loop portions to contact the loop portion, thus biasingly affixing the standard to the frame. In like fashion, additional frames may be connected to the connecting portions 24 of the adjacent frames to extend the horizontal width of the support structure. The support structure may then be formed into any desired shape by pivoting adjacent frames with respect to one another. A "W" shape is shown for instance, in FIG. 3. The connecting portion at the bottom of each frame may be pushed downwardly into the earth to hold the structure in position. If necessary, the support structure may be secured in an upright position by the use of canes 66 having a hook portion 68 formed to engage an arm of frame and the cane is pushed downwardly into the earth at an angle to maintain the support structure in an upright position.

The extending member 54 may be pivoted into the upright position to extend the height of the blink. Clips 16 are then positioned over the connecting portion of the frame and the extending member to fix the extending member in position. Finally, the camouflage cover 12 is positioned over the support structure and secured in place by placing the U-shaped clips 16 over the camouflage cover and support structure wherever necessary to affix the camouflage cover.

When not in use, the portable blind may be disassembled by removing the clips and cover and either folding the frame for easy transportation as best shown in FIG. 4, or disassembling the support structure completely. The frame may be disassembled by aligning the width of the connecting portion 24 with the major axis "b" and deflecting the arm portions outwardly so that the loop slides over the connecting portions of the adjacent frame. When not in use, the camouflage cover and frames by be folded into a compact lightweight package which may be easily carried by hand or in a backpack.

What I claim is:

1. A portable blind comprising:

a support structure comprising, a standard member having a first pair of U-shaped connecting portions, and a plurality of frame members, each of said plurality of frame members having a pair of spaced apart arm portions, each of said pair of arm portions extending between one of a second pair of U-shaped connecting portions and one of a pair of loop portions, each of said pair of loop portions being adapted to receive one of said first pair of connecting portions and said second pair of connecting portions of another of said plurality of frame members within for connectingly forming said support structure, said pair of arm portions being resiliently deformable between a rest position and a second position for accepting one of said first and second pair of U-shaped connecting portions therebetween for assembly and disassembly of said support structure;

means for camouflaging said support structure detachably secured to said support structure; and means for detachably securing said means for camouflaging to said support structure.

2. The portable blind as claimed in claim 1, wherein each connecting portion of said first and second pairs of U-shaped connecting portions has a predetermined width.

3. The portable blind as claimed in claim 2 wherein said loop portion defines an aperture having a predetermined major axis and a predetermined minor axis, said minor axis being smaller than said predetermined width of said U-shaped connecting portion.

4. The portable blind as claimed in claim 3 wherein said major axis of said aperture is greater than said predetermined width of said U-shaped connecting portion for accepting said connecting portion within.

5. The blind as claimed in claim 2 wherein said pair of leg portions of said U-shaped connecting portion are resiliently deflected inwardly towards each other by said loop portion of said plurality of frame members.

6. The portable blind as claimed in claim 1 wherein said means for camouflaging further comprises a flexible material member having a width and length dimensioned to cover said support structure.

7. The portable blind as claimed in claim 1 wherein said means for detachably securing further comprises a plurality of first U-shaped clips.

8. The portable blind as claimed in claim 1 wherein said support structure further comprises:

a vertical extending member pivotally connected to each said plurality of frame members, said vertical extending member pivotable between a storage position and an extended position; means for pivotally connecting said extending member to each of said plurality of frame members; and means for locking said vertical extending member in said extended position.

9. The portable blind as claimed in claim 8 wherein said means for locking comprises at least one of said plurality of U-shaped clips

* * * * *

UNITED STATES PATENT AND TRADEMARK OFFICE

CERTIFICATE OF CORRECTION

PATENT NO. : 4,773,437

DATED : 9/27/88

INVENTOR(S) : Roy H. Glutting

It is certified that error appears in the above-identified patent and that said Letters Patent is hereby corrected as shown below:

Col. 2, line 43, delete "a" and insert --an--;

line 62, delete "a" and insert --an --;

Col. 3, line 43, delete "connection" and insert --connecting--;

Col. 4, line 36, delete "frames" and insert --frame--;

line 38, delete "securly" and insert --securely--;

Col. 5, line 1 after "of", insert --the--;

line 6, delete "blink" and insert --blind--;

line 24, delete "by" and insert --may--;

Col. 6, line 21, delete "are" and insert --is--.

Signed and Sealed this

Twenty-third Day of May, 1989

*Attest:*

*Attesting Officer*

DONALD J. QUIGG

*Commissioner of Patents and Trademarks*